US006286625B1

(12) United States Patent
AstvasaDoorian

(10) Patent No.: US 6,286,625 B1
(45) Date of Patent: Sep. 11, 2001

(54) ROPE CLIMBING DEVICE

(76) Inventor: Wilfred AstvasaDoorian, 1127 E. Nees Ave., Fresno, CA (US) 93720

( * ) Notice: Subject to any disclaimer, the term of this patent is extended or adjusted under 35 U.S.C. 154(b) by 0 days.

(21) Appl. No.: 09/535,977

(22) Filed: Mar. 27, 2000

(51) Int. Cl.[7] ..... A63B 27/00
(52) U.S. Cl. ..... 182/134; 182/221
(58) Field of Search ..... 182/133, 134, 182/192, 5, 221

(56) References Cited

U.S. PATENT DOCUMENTS

| | | | | |
|---|---|---|---|---|
| 580,794 | | 4/1897 | Money . | |
| 1,505,360 | | 8/1924 | Lowery . | |
| 1,516,564 | | 11/1924 | Barthelemy . | |
| 1,895,571 | | 1/1933 | Hein . | |
| 3,717,219 | | 2/1973 | Hoffman . | |
| 3,724,593 | * | 4/1973 | O'Keefe | 182/134 |
| 3,938,620 | | 2/1976 | Nothiger . | |
| 4,531,610 | * | 7/1985 | Fertier | 182/5 |

FOREIGN PATENT DOCUMENTS

| | | | | |
|---|---|---|---|---|
| 174970 | * | 9/1906 | (DE) | 182/134 |

* cited by examiner

*Primary Examiner*—Alvin Chin-Shue
(74) *Attorney, Agent, or Firm*—Richard A. Ryan

(57) ABSTRACT

A rope climbing device that attaches to a person's feet for assisting with ascending or descending along a rope. The rope climbing device has a frame that is shaped into a housing on one side and a base member on the opposing side. At least partially enclosed in the housing is a slide member that slides along the frame. Hooks protruding from the slide member are inserted into or engage a rope placed in the housing between a pair of pivoting cams. The downward force on the base member resulting from the user's weight moves the slide member upward relative to the frame. Due to this action, an actuating mechanism attached to the slide member pivots the pair of cams inward to tightly grip the rope, allowing the person to move his or her other foot upward or downward along the rope. When the downward force from the person's weight is released from the base member, springs attached to the cams cause the cams to pivot outward to an open position so the person may disengage the hooks from the rope and move his or her foot upward or downward.

22 Claims, 4 Drawing Sheets

ROPE CLIMBING DEVICE

BACKGROUND OF THE INVENTION

1. Field of the Invention

The field of the present invention relates generally to devices that are used for descending or ascending ropes, cables and the like. In particular, the present invention relates to rope climbing devices that are capable of supporting a person's weight and making it easier for a person to climb upwardly or downwardly along a rope used as a fire escape or to ascent or descent a structure, mine, cave and other places.

2. Background

Rope climbing is generally thought to be limited to the realm of mountain climbers, firefighters and others having particular skill and training for safely ascending and descending on a rope, cable or similar materials. As such, people who climb ropes under these circumstances typically have specialized equipment which they use. This equipment is generally very sophisticated and requires considerable training and experience to safely use for ascending or descending vertical distances of any significant length. However, the need for others to ascend or descend along a rope who do not have the specialized equipment used by professionals and experienced climbers or who are not trained or experienced in the use of such equipment does arise on a not infrequent basis.

The need for the inexperienced person to ascend or descend on a rope can arise under various conditions. For instance, ropes and the like can be used in various rescue situations to save a person from injury or even death. Examples of few such situations include the need to exit the higher floors of a burning building, to climb down from a structure upon which a person has become stuck or to climb up a rope to escape rising flood waters or other conditions. With the prevalence of high rise buildings for work and homes, the potential for needing to use a rope for fire escape, in particular, is a more common possibility for the average person. Typically, the average person does not have the equipment, skill or training to safely ascend or descend along a rope. As a result, unfortunately, when the need does arise, the person is generally left unable to utilize a rope to effectuate a quick and safe exit from a dangerous situation (i.e., fire).

Various devices have been developed for use to assist persons with the ascent or descent along a rope. For the most part, the prior art devices are complex in design and require considerable training and experience to safely utilize. In addition, these devices are generally heavy, bulky to carry or store and expensive to purchase for the off chance it will be needed. U.S. Pat. No. 3,717,219 to Hoffman describes a device that comprises various straps that must go around the body and a friction apparatus that the rope is wound around in a specific manner to slow descent. This patent also describes the use of a foot apparatus for ascent that requires coordinated movement of both feet in order to sufficiently clamp and un-clamp the rope. U.S. Pat. No. 1,505,360 to Lowery describes the use of a leg or stirrup mounted device for climbing a rope that utilizes a cam-type of apparatus having serrations on the cam surfaces for engaging and clamping the rope by shifting the weight of the person using the device. These and other rope gripping devices have not be universally accepted for use by unskilled persons desiring to quickly and safely exit a building or other location to escape danger, including fire. What is needed, is a device that is relatively simple to use for safely ascending or descending along a rope by persons who do not have skill or experience with such devices or rope climbing in general.

SUMMARY OF THE INVENTION

The rope climbing device of the present invention solves the problems identified above. That is to say, the present invention provides a rope climbing device that is relatively simple to use, inexpensive to manufacture and adaptable for ascending and descending a rope, wire cable and other such climbing materials. Specifically, the present invention discloses a device that attaches to a person's foot and connects to a rope for relatively simple ascent or descent along the rope without the need for any special skills, technique or physical condition.

In the primary embodiment of the present invention, the rope climbing device comprises a frame having a first side and an opposing second side. The frame is shaped and configured to have a base member, center portion and a housing. The housing is on the first side of the frame and the base member extends in a generally perpendicular direction from the second side of the frame such that the housing is on one side of the frame and the base member is on the opposite side. The base member must be suitable for placement of a person's foot or shoe thereon during ascent or descent along a rope. The housing encloses, at least partially, a slide member that is slidably attached to the frame in a direction that is generally parallel to the plane of the frame. Protruding from the slide member is one or more hooks or hook-like elements that are suitable for at least partial insertion or engagement with the rope. In the preferred embodiment, the housing also encloses a pair of opposing cams that are pivotally attached to the frame and/or housing. The cams pivot between an open position and a gripping position. A spring disposed around the pivot shaft and between the cam and the frame or housing operatively engages the spring to force it to remain in the open position or to move it from the gripping position to the open position. An actuating mechanism, such as an actuator spring, is attached to and moves with the slide member. The actuating mechanism is also attached to the cams, such that upward movement of the actuating mechanism results in the cams pivoting inward to the gripping position.

To use the device of the present invention, the person desiring to ascend or descend along a rope securely attaches a device to each foot or shoe with a securing mechanism, such as a strap or other mechanism, that is attached to the frame, housing and/or base member. Once the device is fastened to the foot or shoe, the rope is disposed in the device between the two cams such that the hooks are at least partially inserted in or engage the rope. When a downward force, such as all or part of the person's body weight, is applied to the base member while the hooks are inserted in or engaged with the rope, the slide member moves upward relative to the frame or center portion of the frame. This upward movement of the slide mechanism causes the actuating mechanism to move the cams from the open position to the gripping position to tightly grip the rope therebetween. Once the rope is tightly engaged between the cams, the person can place their weight thereon and move the other foot upward or downward, depending on whether ascent or descent is desired, to engage the device on the other foot or shoe. In this manner, the person using the present invention climbs up or down the rope as if they were climbing stairs or a ladder.

The device of the present invention does not require the use of the person's hands to operate the device. The hands are left free to grip the rope or use one hand to grip the rope and the other hand to hold on to an object or another person. The present invention can also be utilized to move along a rope that is other than vertically disposed. For instance, with very little practice, the device of the present invention can be utilized to move along a rope that is strung horizontally, such as a rope that traverses a natural chasm or a gap between two structures.

Accordingly, the primary objective of the present invention is to provide a rope climbing device that relatively simple to make and easy to use for ascending or descending along a rope.

It is also an important objective of the present invention to provide a rope climbing device that securely attaches to a person's foot or shoe and which does not require use of the hands to operate.

It is also an important objective of the present invention to provide a rope climbing device that has a pair of cams pivotally attached to a frame having a sliding member that moves in response to a downward force on the base member attached to the frame such that the cams pivot to tightly grip a rope.

It is also an important objective of the present invention to provide a rope climbing device that utilizes one or more hooks protruding from a sliding member slidably attached to a frame to engage a rope disposed between a pair of pivoting cams that tightly grip the rope in response to a downward force on a base member attached to the frame.

Yet another important objective of the present invention is to provide a rope climbing device that allows a person to ascend or descend along a rope using body motions that are similar to ascending or descending stairs and ladders.

The above and other objectives of the present invention will be explained in greater detail by reference to the attached figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
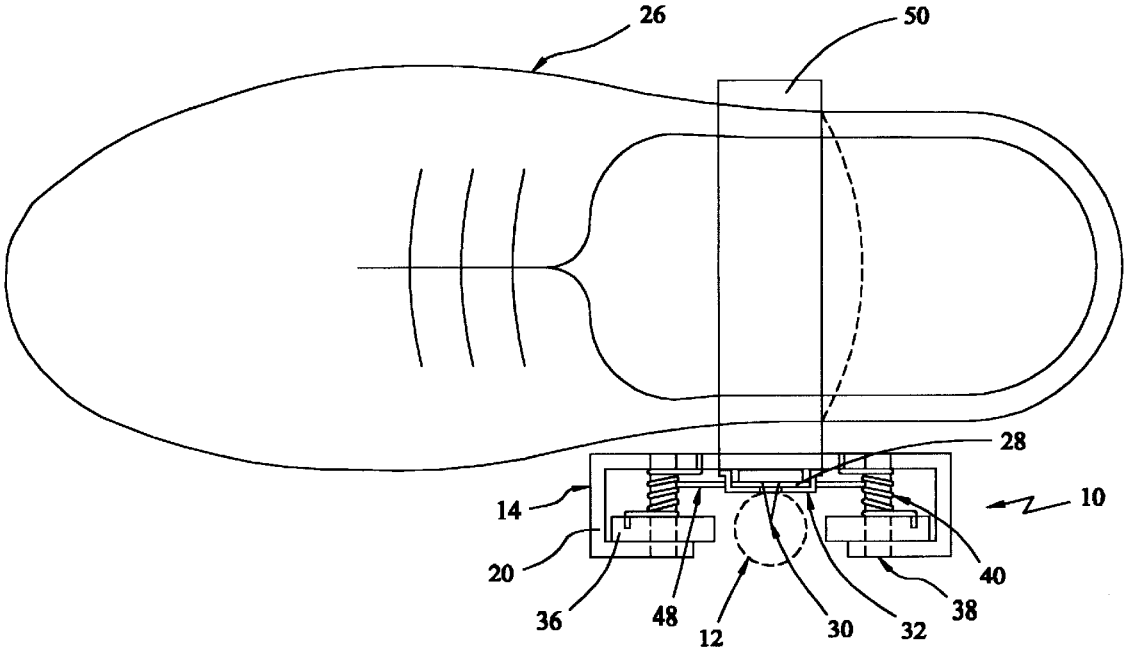
FIG. 1 is a top view of the preferred embodiment of the present invention.

With reference to the figures where like elements have been given like numerical designations to facilitate the reader's understanding of the present invention, and with particular reference to the present invention illustrated in FIGS. 1 through 6, the preferred embodiment of the present invention is set forth below. The rope climbing device, designated generally as 10, allows a person to climb along rope 12, generally in a ascending or descending manner. Rope 12 can be of any type of rope commonly used for climbing, such as ropes made out of cotton, nylon, combinations of cotton, nylon and/or other materials. In addition, rope 12 can be made out of materials not commonly used for ropes, such as various metals and composite materials that are suitable for the present invention described below. One end of rope 12 will be attached to the structure, mine, cave or other object that the person desires to ascend or descend from. For instance, rope 12 can be utilized as a fire escape tool that attaches to a window sill or other part of a building or structure so that the person may descend to safety below.

As shown in FIGS. 1 through 6, the rope climbing device of the present invention generally comprises frame 14 having a first side 16 and second side 18 opposite first side 16. Frame 14 should be made from a strong material that can be fixedly shaped as desired and yet maintain that shape under loads typically expected from persons who may use device 10 (i.e., up to 300 pounds or so), so that the climber may bear his or her entire weight on device 10. Because device 10 is intended to be stored until it is needed, which may be for some time, the material chosen for frame 14 should be somewhat corrosion resistant. Preferably, the material chosen for frame 14 should be lightweight, making it easy to carry to where it may be needed.

In the preferred embodiment, frame 14 is shaped to form housing 20, base member 22 and center portion 24. In one embodiment, frame 14 starts off as a generally cross-shaped frame prior to forming housing 20 and base member 22. Housing 20 can be formed by bending in the "arms" of the cross towards the first side 16 of center portion 24. Base member 22 can be formed by bending the bottom of frame 14 upward towards the center portion 24 on second side 18. Other configurations are also possible. In fact, frame 14, housing 20 and base member 22 can comprise three separate pieces that are joined to form the device 10 of the present invention. In this configuration, housing 20 can be attached to the first side 16 of frame 14 and base member 22 can be attached to the second side 18 of frame 14. The purpose of housing 20 is to provide some level of protection to the components that are housed in housing 20 and provide support for those components. For purposes of general use of the present invention, however, it is not necessary that housing 20 fully enclose or seal the components housed therein. In fact, as described below and best shown in FIG. 1, rope 12 must be able to easily enter housing 20 in order for device 10 to function as a rope climbing device. If deemed desirable, device 10 cannot use housing 20 and still function as set forth below. Base member 22 should extend outwardly in a generally perpendicular relationship from frame 12 or center portion 24 a sufficient distance that the person utilizing device 10 to climb a rope can place his or her foot or shoe (shown as 26 in FIGS. 1 and 2) on base member 22 for support and to make device 10 grip rope 12 during the climbing process. For comfort and safety, base member 22 should be sized and configured to extend outwardly far enough that the full width of the typical foot or shoe 26 can rest on base member 22 (i.e., a distance of three to four inches). If desired, a hinge (not shown) can be utilized to allow base member 22 to fold up when not in use and fold down when device 10 will be used for climbing. Naturally, any such hinge must be sufficiently strong to support the weight designed for device 10 as a whole.

Slidably attached to the first side 16 of frame 14 is slide member 28. Slide member 28 should be able to freely slide in a direction generally parallel to frame 14 or center portion 24. Slide member 28 is housed within frame 14. Protruding from slide member 28 is hook 30, which prevent slide member 28 from falling through frame 14. Hook 30 should be sized and configured to be adaptable for at least partial insertion into rope 12 for use of device 10 to ascend or descend along rope 12. Hooks 30 can be shaped as shown or can be more of a spike, nail or similar shape. Hooks 30 must be of sufficient strength to not break under the loads and forces typically expected during use of the present invention. Preferably, hooks 30 will protrude from slide member 28 in a generally perpendicular direction relative to frame 14 or center portion 24. Other angles, such as a downward angle, for hooks 30 are possible. However, the generally perpendicular hook 30 direction is most suitable for both ascent and descent along rope 12. As shown in the various figures, the preferred embodiment utilizes more than one hook 30 in device 10. The use of multiple hooks 30 is desirable to ensure hook 30 engages rope 12 and, for safety purposes, as a back-up in case one hook 30 is damaged and cannot function as described in more detail below. Although only two such hooks 30 are shown, any number of hooks can be utilized with device 10. The preferred embodiment, as shown, utilizes two hooks 30 to balance the need for safety and the functionality of device 10. An excessive number of hooks 30 may make the function of device 10 more difficult and, therefore, less safe than the use of fewer hooks 30. Hook 30 should be fixedly attached to slide member 28 such that when force is applied to base member 22 (i.e., when the weight of the person is place downward on base member 22) while hook 30 is engaged in rope 12, the slide member 28 will easily slide upward relative to frame 14 attached to or integral with base member 22. The preferred embodiment also includes a slide housing 32 attached to frame 14 such that it encloses hooks 30 to protect hooks 30 from damage. Hooks 30 should protrude from a slot 34 in slide housing 32 a sufficient distance to be able to engage rope 12 so device 10 can function as set forth herein.

Figure 3:
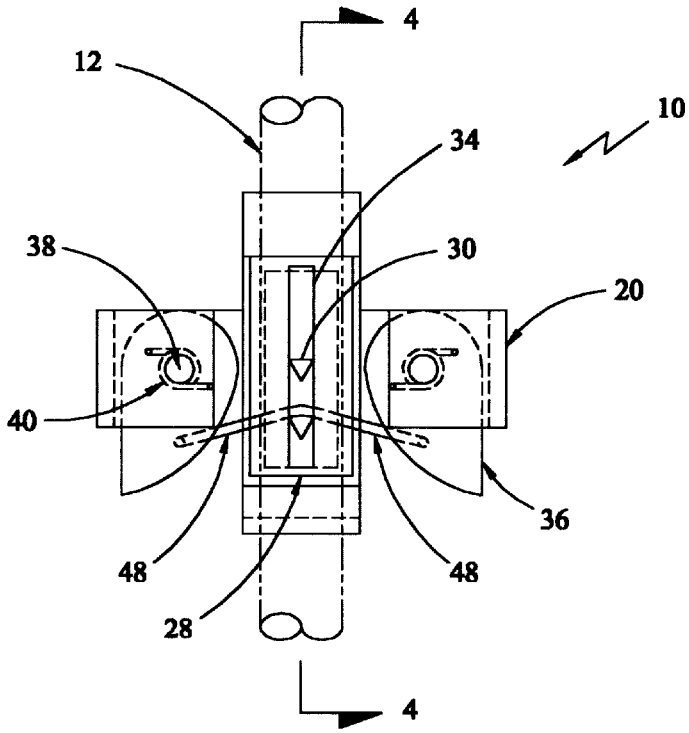
FIG. 3 is a side view of the present invention with a portion of the housing removed to better show the cam and actuator mechanism.
Figure 4:
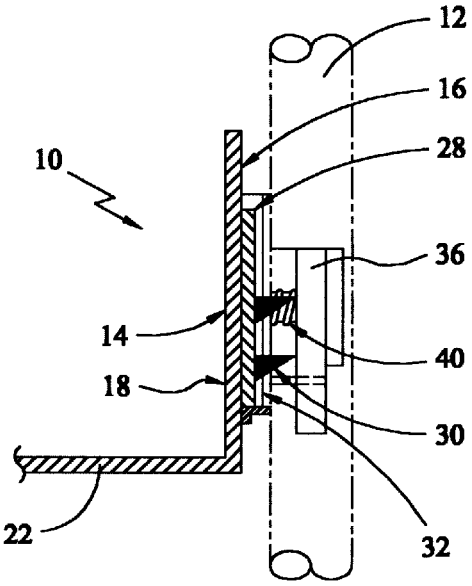
FIG. 4 is a cross-sectional view of the present invention taken through 4—4 on FIG. 3.
Figure 5:
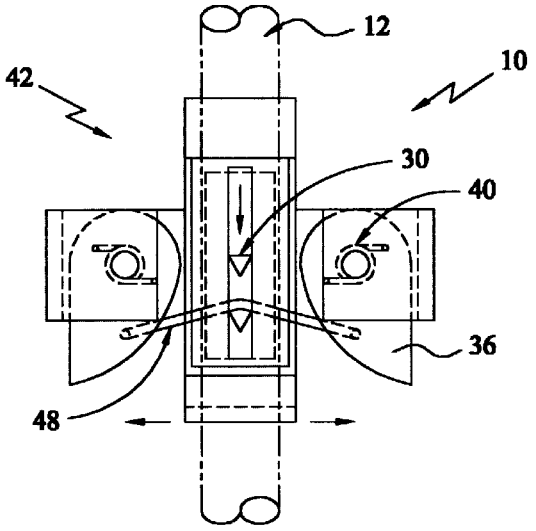
FIG. 5 is a side view of the present invention with a portion of the housing removed to better show the cam and actuator mechanism in the open position.
Figure 6:
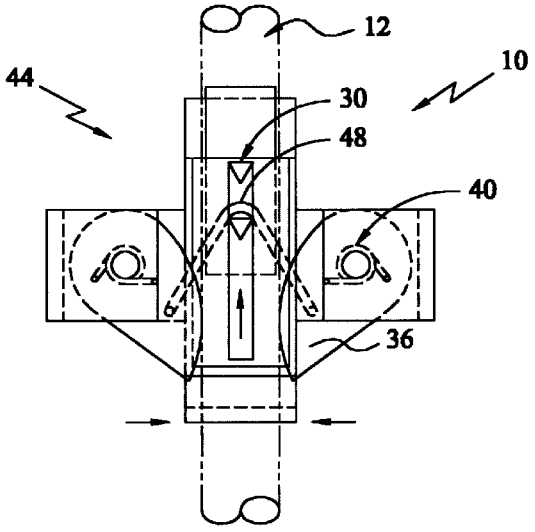
FIG. 6 is a side view of the present invention with a portion of the housing removed to better show the cam and actuator mechanism in the gripping position.

Also attached to first side 16 of frame 14 is at least one cam 36. In the preferred embodiment, as shown in FIGS. 1, 3, 5 and 6, two cams 36 are used. Cams 36 are pivotally attached to frame 14 with use of pivot shaft 38. Disposed around pivot shaft 38 and between cam 36 and first side 16 of frame 14 is a spring 40 that operatively engages each of cams 36 to hold cams in the open position 42 shown in FIG. 5. Springs 40 should provide enough force on cams 36 that they are not easily moved to the gripping position 44, shown in FIG. 6, which results from the downward force on base member 22 as describe below. When this downward force is removed, springs 40 should quickly move cams 36 from the gripping position 44 to the open position 42. Cams 36 should be spaced apart a sufficient distance that rope 12 can be placed between cams 36 when in the open position 42. When in the gripping position 44, cams 36 must tightly grip rope 12 so as to prevent undesirable and potentially dangerous slippage of device 10 down rope 12 while climbing. Cams 36 should be shaped so as to be able to tighten on a range of ropes 12 having different diameters. The typical "cam" shape, as shown in FIGS. 3, 5 and 6, should be sufficient for this purpose. The edge of the cams 36 that contact the rope 12 can be smooth, as shown, or it can be serrated to improve the gripping action of the cams 36 against rope 12.

Figure 7:
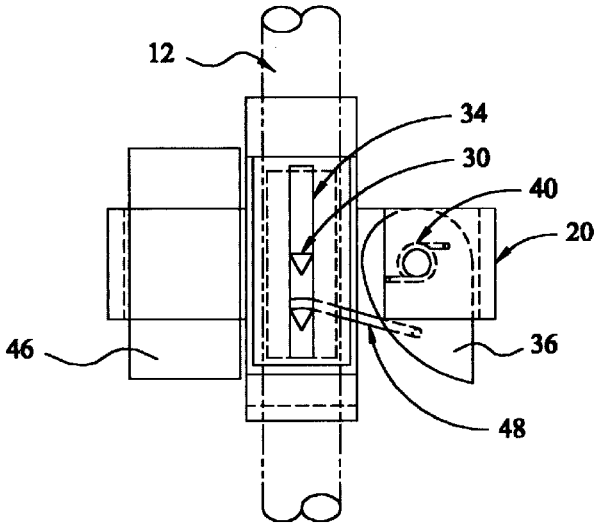
FIG. 7 is a side view of an alternative embodiment of the present invention utilizing only one cam.

In an alternative embodiment of the present invention, shown in FIG. 7, one of the cams 36 can be replaced by a cam resistor 46, which can be a piece of solid metal spaced apart from the single cam 36 such that as cam 36 moves from the open position 42 to the gripping position 44, cam 36 compresses the rope 12 between cam 36 and cam resistor 46. In this embodiment, the cam resistor 46 does not pivot and, as a result, does not require spring 40 to move it back in the open position 42. While this embodiment can function as desired, it is not the preferred embodiment due to the ability of the dual cam 36 arrangement to more tightly grip rope 12 to prevent slippage.

Figure 8:
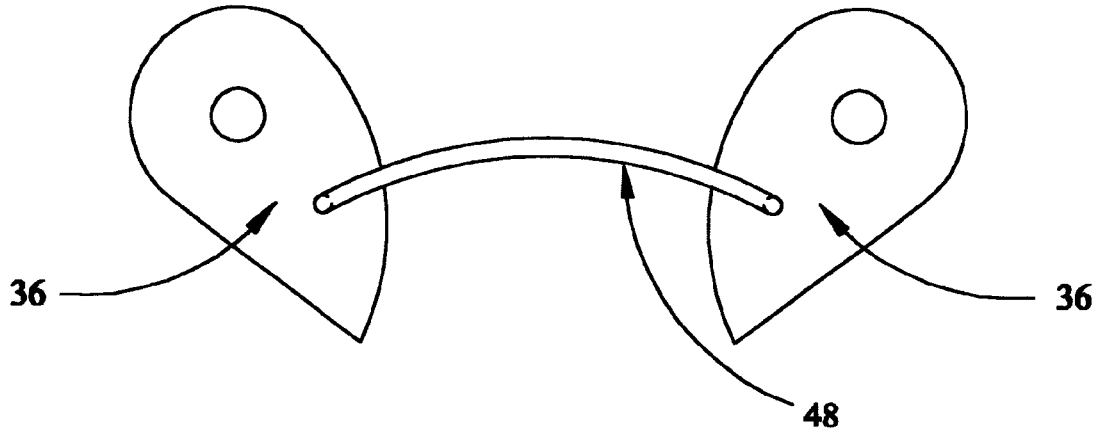
FIG. 8 is a back side view of the cams and actuating mechanism of the present invention.
Figure 9:
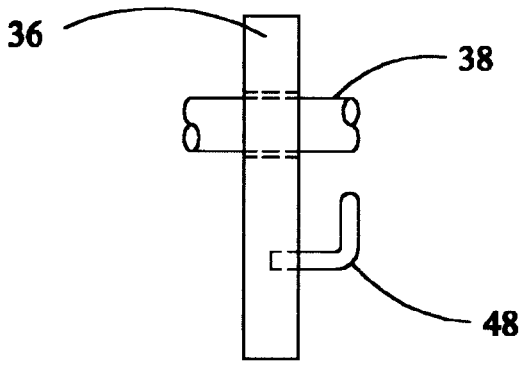
FIG. 9 is a side view of a cam showing the connection of the actuating mechanism to the cam.

Connecting cams 36 to slide member 28 is an actuating mechanism, such as actuator spring 48 shown in the accompanying figures, that moves cams 36 from the open position 42 to the gripping position 44 as slide member 28 moves upward relative to frame 14 as a result of a downward force on base member 22. As shown in FIGS. 3, 5 and 6, the actuating mechanism 48 can be a spring bar attached at or near its middle to slide member 28 at one of the hooks 30 and at or near its ends to cams 36 (when two cams are used). Actuating mechanism 48 helps prevent slide member 28 from falling through frame 14. As shown in FIGS. 8 and 9, actuating mechanism 48 of the preferred embodiment is hooked into cams 36 by bending the end of actuating mechanism 48 at an angle of approximately 90 degrees and inserting the end into cam 36. This prevents actuating mechanism 48 from disconnecting from cams 36. As shown in FIGS. 5 and 6, when the cams 36 are in the open position 42, the actuating mechanism 48 does not apply any force or supplies an insufficient force to overcome the effect of springs 40 that hold the cams 36 in the open position 42. As the base member 22 is forced downward due to the weight of the person using device 10, slide member moves upward relative to frame 14. This action moves the center of actuating mechanism 48 upward and brings its ends inward, thereby pivoting cams 36 inward towards rope 12 to tightly grip rope 12.

Figure 2:
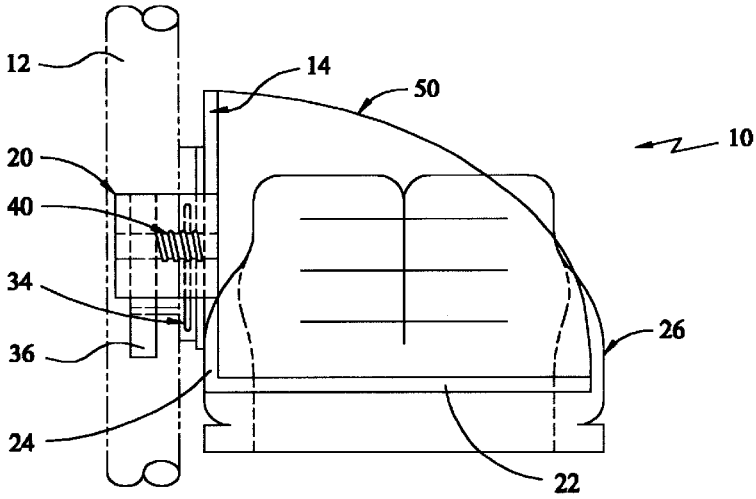
FIG. 2 is a back view of the embodiment of the present invention shown in FIG. 1.

To secure the device to a persons foot or shoe 26, device 10 should use a securing mechanism, such as the strap 50 shown in FIGS. 1 and 2. As shown, strap 50 can connect to base member 22 and the top of housing 20. Alternatively, strap 50 can connect to frame 14, circumvent the entire device or any of various other configurations in order to provide a mechanism for securely attaching device 10 to foot or shoe 26. As is known, instead of a single strap, securing mechanism 50 can comprise a plurality of straps or various tying, buckling and other securing mechanisms, including combinations thereof. The configuration of base member 22 and strap 50 will generally resemble a stirrup-like device that is suitable for placement of the foot or shoe 26 therein and then securely fastening the device 10 to the foot or shoe 26. Preferably, once strap 50 or other securing mechanism is securely fastened to the foot or shoe 26, device 10 should move in unison with the foot or shoe 26.

In use, the person who desires to utilize device 10 to ascend or descend a rope 12 will attach device 10 to his or her foot or shoe 26 by sufficiently opening strap 50 to allow the person to place his or her foot or shoe 26 on top of base member 22 or between base member 22 and strap 50 and then securely fastening strap 50 so as to secure device 10 to foot or shoe 26. The person then securely places a device 10 on the other foot or shoe 26. Once one end of the rope 12 is attached to a window sill, structure or other non-movable object, the person places the rope 12 in device 10 between cams 36 such that hooks 30 are at least partially inserted in or engaged by rope 12. Downward force from the person's weight on base member 22 while hooks 30 are engaged will result in the upward movement of slide member 28 relative to frame 14, causing the actuating mechanism 48 to pivot cams 36 from the open position 42 to the gripping position 44 so that device 10 tightly and securely grips rope 12. The same process is repeated for the person's other foot.

To ascend or descend rope 12, the person merely moves their feet as they would if they were ascending or descending stairs or the like. By taking the weight off of one foot, the downward force on base member 22 is released and springs 40 pivot cams 36 from the gripping position 44 to the open position 42. This allows the person to disengage hooks 30 from rope 12 and move his or her foot 26 upward or downward (depending whether ascent or descent is desired) a comfortable distance where the device 10 re-engages rope 12 and the process is repeated. As can be determined from the description of the operation of device 10, use of device 10 does not require the person to utilize their hands in conjunction with device 10. This frees the person to utilize their hand or hands to hold onto rope 12 or other objects while ascending or descending along rope 12.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A rope climbing device for climbing a rope, comprising:

a frame having a first side and an opposing second side;

a base member attached to said frame, said base member substantially perpendicular to said frame, said base member sized and configured for placement of a foot or shoe thereon;

a slide member slidably connected to said frame;

a hook protruding from said slide member;

a cam pivotally attached to said frame;

a second cam pivotally attached to said frame, said second cam sufficiently spaced apart from said cam for the rope to be engaged between said cam and said second cam;

a spring operatively engaging said cam for holding said cam in an open position and for moving said cam from a gripping position to said open position; and actuating means operatively interconnecting said slide member and said cam for moving said cam from said open position to said gripping position, said actuating means also operatively interconnecting said slide member and said second cam for moving said second cam from said open position to said griping position.

2. The rope climbing device according to claim 1 further comprising a housing on said first side of said frame, said cam and said second cam disposed in said housing.

3. The rope climbing device according to claim 1 further comprising a second spring operatively engaging said second cam for holding said second cam in said open position and for moving said second cam from said gripping position to said open position.

4. The rope climbing device according to claim 1, wherein said hook protrudes from said slide member in a direction generally perpendicular to said slide member.

5. The rope climbing device according to claim 1, wherein said slide member slides substantially parallel to said frame.

6. The rope climbing device according to claim 1, wherein said hook is sized and configured to be adaptable for at least partial insertion into the rope.

7. The rope climbing device according to claim 1 further comprising securing means attached to said device for securing the foot or shoe to said base member.

8. The rope climbing device according to claim 7, wherein said securing means comprises one or more strap members attached to said frame.

9. The rope climbing device according to claim 1 further comprising a plate housing attached to said frame, said plate housing having a slot, said hook protruding past said plate housing through said slot.

10. A rope climbing device for climbing a rope, comprising:

a frame having a first side and an opposing second side;

a base member extending from said second side of said frame, said base member substantially perpendicular to said frame, said base member sized and configured for placement of a foot or shoe thereon;

a slide member slidably connected to said first side of said frame, said slide member movement being substantially parallel to said frame;

a hook protruding from said slide member, said hook sized and configured to be adaptable for at least partial insertion into the rope;

a pair of cams pivotally attached to said first side of said frame, said pair of cams sufficiently spaced apart for the rope to be engaged between said pair of cams;

a spring operatively engaging said pair of cams for holding said pair of cams in an open position and for moving said pair of cams from a gripping position to said open position; and actuating means operatively interconnecting said slide member and said pair of cams for moving said pair of cams from said open position to said gripping position.

11. The rope climbing device according to claim 10 further comprising a housing on said first side of said frame, said pair of cams disposed in said housing.

12. The rope climbing device according to claim 11 further comprising securing means attached to said device for securing the foot or shoe to said base member.

13. The rope climbing device according to claim 10 further comprising a plate housing attached to said frame, said plate housing having a slot, said hook protruding past said plate housing through said slot.

14. The rope climbing device according to claim 10, wherein said hook protrudes from said slide member in a direction generally perpendicular to said slide member.

15. A rope climbing device for climbing a rope, comprising:

a frame having a first side and an opposing second side, said frame shaped and configured to form a housing on said first side of said frame, a base member on said second side of said frame and a center portion between said housing and said base member, said base member substantially perpendicular to said center portion of said frame, said base member sized and configured for placement of a foot or shoe thereon;

a slide member slidably connected on said first side of said frame to said center portion of said frame, said slide member movement being substantially parallel to said center portion of said frame;

a hook protruding from said slide member, said hook sized and configured to be adaptable for at least partial insertion into the rope;

a pair of cams pivotally attached to said first side of said frame, said pair of cams sufficiently spaced apart for the rope to be engaged between said pair of cams;

a spring operatively disposed between each of said cams for holding said cams in an open position and for moving said cams from a gripping position to said open position; and actuating means operatively interconnecting said slide member and each of said cams for moving said pair of cams from said open position to said gripping position.

16. The rope climbing device according to claim 15, wherein said hook protrudes from said slide member in a direction generally perpendicular to said slide member.

17. The rope climbing device according to claim 15 further comprising securing means attached to said device for securing the foot or shoe to said base member.

18. The rope climbing device according to claim 15 further comprising a plate housing attached to said center portion of said frame, said plate housing has a slot, said hooks protruding past said plate housing through said slot.

19. A rope climbing device for climbing a rope, comprising:

a frame having a first side and an opposing second side;

a base member attached to said frame, said base member substantially perpendicular to said frame, said base member sized and configured for placement of a foot or shoe thereon;

a slide member slidably connected to said frame;

a hook protruding from said slide member, said hook sized and configured to be adaptable for at least partial insertion into the rope;

a cam pivotally attached to said frame;

a cam resistor attached to said frame, said cam resistor sufficiently spaced apart from said cam for the rope to be engaged between said cam and said cam resistor;

a spring operatively engaging said cam for holding said cam in an open position and for moving said cam from a gripping position to said open position; and actuating means operatively interconnecting said slide member and said cam for moving said cam from said open position to said gripping position.

20. The rope climbing device according to claim 19, wherein said cam resistor is a second cam pivotally attached to said frame.

21. The rope climbing device according to claim 20 further comprising a second spring operatively engaging said second cam for holding said second cam in said open position and for moving said second cam from said gripping position to said open position.

22. The rope climbing device according to claim 20, wherein said actuating means operatively interconnects said slide member and said second cam for moving said second cam from said open position to said gripping position.

* * * * *